US007033508B2

(12) United States Patent
Sullivan

(10) Patent No.: US 7,033,508 B2
(45) Date of Patent: Apr. 25, 2006

(54) CONTAMINANT FLUSHING DEVICE, SYSTEM, AND METHOD, PARTICULARLY SUITED FOR REFRIGERATION SYSTEM SERVICING

(76) Inventor: Paul Joseph Sullivan, 1125 Nathan La. North, Plymouth, MN (US) 55441

( * ) Notice: Subject to any disclaimer, the term of this patent is extended or adjusted under 35 U.S.C. 154(b) by 0 days.

(21) Appl. No.: 10/351,424

(22) Filed: Jan. 27, 2003

(65) Prior Publication Data

US 2004/0144700 A1 Jul. 29, 2004

(51) Int. Cl.
*B01D 37/00* (2006.01)

(52) U.S. Cl. ..... 210/741; 62/77; 62/149; 62/292; 62/474; 62/475; 210/95; 210/745; 210/805

(58) Field of Classification Search ..... 210/90, 210/94, 95, 167, 168, 257.1, 258, 741, 745, 210/805; 62/77, 127, 129, 149, 292, 474, 62/475

See application file for complete search history.

(56) References Cited

U.S. PATENT DOCUMENTS

| | | | | | |
|---|---|---|---|---|---|
| 2,019,421 | A * | 10/1935 | Link | 137/68.12 |
| 4,441,330 | A * | 4/1984 | Lower et al. | 62/149 |
| 5,170,632 | A * | 12/1992 | Reilly, Jr. et al. | 62/77 |
| 5,247,802 | A * | 9/1993 | Maniez et al. | 62/77 |
| 5,330,636 | A * | 7/1994 | Reichert | 210/96.1 |
| 5,452,585 | A * | 9/1995 | Pincus et al. | 62/84 |
| 5,565,094 | A * | 10/1996 | Zoch et al. | 210/86 |
| 6,247,325 | B1 * | 6/2001 | Muston et al. | 62/292 |

* cited by examiner

*Primary Examiner*—Joseph Drodge
(74) *Attorney, Agent, or Firm*—Shlesinger, Arkwright & Garvey LLP

(57) ABSTRACT

Fluid decontamination device includes a base having a fluid passage in it. An observation window is provided in the base for allowing a user to observe a fluid in the fluid passage. A differential pressure indicator, such as a vacuum indicator, is operatively connected to the fluid passage for indicating the relative pressure in the fluid. An indicator light which turns on when the differential pressure in the fluid passage is less than a predetermined differential pressure may be provided on the differential pressure indicator. A filter may be fluidly connected with the fluid passage for filtering out one or more contaminants present in the fluid.

9 Claims, 1 Drawing Sheet

CONTAMINANT FLUSHING DEVICE, SYSTEM, AND METHOD, PARTICULARLY SUITED FOR REFRIGERATION SYSTEM SERVICING

CROSS REFERENCE TO RELATED APPLICATION

This application relates to applicant's concurrently filed application Ser. No. 10/351,404, filed Jan. 27, 2003, entitled "QUICK RELEASE TOOL FOR ENGAGING ELONGATED OBJECTS, PARTICULARLY SUITED FOR USE WITH TUBING", which is incorporated herein by reference.

FIELD OF THE INVENTION

The invention relates to a device, system, and method of removing contaminants from a fluid. More particularly, the invention relates to a device, system, and method for removing contaminants in a liquid. Even more particularly, the inventor relates to a device, system and method for flushing contaminants out of a refrigeration system.

BACKGROUND OF THE INVENTION

Devices for removing contaminants from a fluid are known.

Fluid based systems, such as refrigeration systems, may become contaminated owing to a system failure, such as a failed compressor or motor, a leak in a part of the closed fluid system, improper servicing and the like. Contaminants typically include liquid or water vapor, oil, solder, and by-products of over-heated system components, such as coils, seals, valves, compressors and motors.

When a user switches a refrigerant in a system to a different refrigerant, such as when switching over from R-12 to R-134, residual oil from a prior installation is considered a contaminant.

In a refrigeration system, a current method requires the removal of contamination by flushing virgin refrigerant through the system into a container, such as an OZ™ saver bag or a similar device, or a refrigerant recovery cylinder. These known methods have an inherent drawback in that refrigerant is transferred at a low differential pressure. The operation is thus time-consuming and costly. In the case where a tank is used, a vacuum must be "pulled" in order to generate a differential pressure.

In addition, known methods require the subsequent evacuation of the contaminant/refrigerant containing container after use, thus lengthening the time required for the contaminant removal procedure.

Still further, in the case of water vapor contamination, there is a time-consuming evacuation procedure using a vacuum pump to pull the system down to a pressure differential in the 30 millitorr range for 20–30 minutes.

OBJECTS AND SUMMARY OF THE INVENTION

An object of the invention is to overcome the drawbacks of prior art devices, system and methods.

A further object of the invention is to reduce the length of time required, while concurrently reducing the quantity of virgin refrigerant required.

A still further object of the invention is to provide a device, system and method that is easier and more reliable to use than known devices.

Another object of the invention is to provide a simpler device for removing contaminants, that requires less space than known devices, and/or reduces the time required to remove contaminants.

In sum, the inventive device include an observation window situated for observing contaminated fluid to be decontaminated and a differential pressure indicator provided for indicating the pressure in the fluid to be decontaminated.

The inventive device may likewise include a fluid filter fluidly connected to the fluid to be decontaminated.

Still further, the inventive device may include one or more valves to regulate fluid flow, and may include a system in which one or more of an observation window, a pressure differential indicator, and a filter are fluidly connected.

A system and method for decontaminating a fluid are likewise provided.

It will be appreciated that relative terms such as up, down, left, and right are for convenience only and are not intended to be limiting. Likewise, a vacuum indicator may be considered another term for a differential pressure gauge.

DETAILED DESCRIPTION OF THE INVENTION

Figure 1:
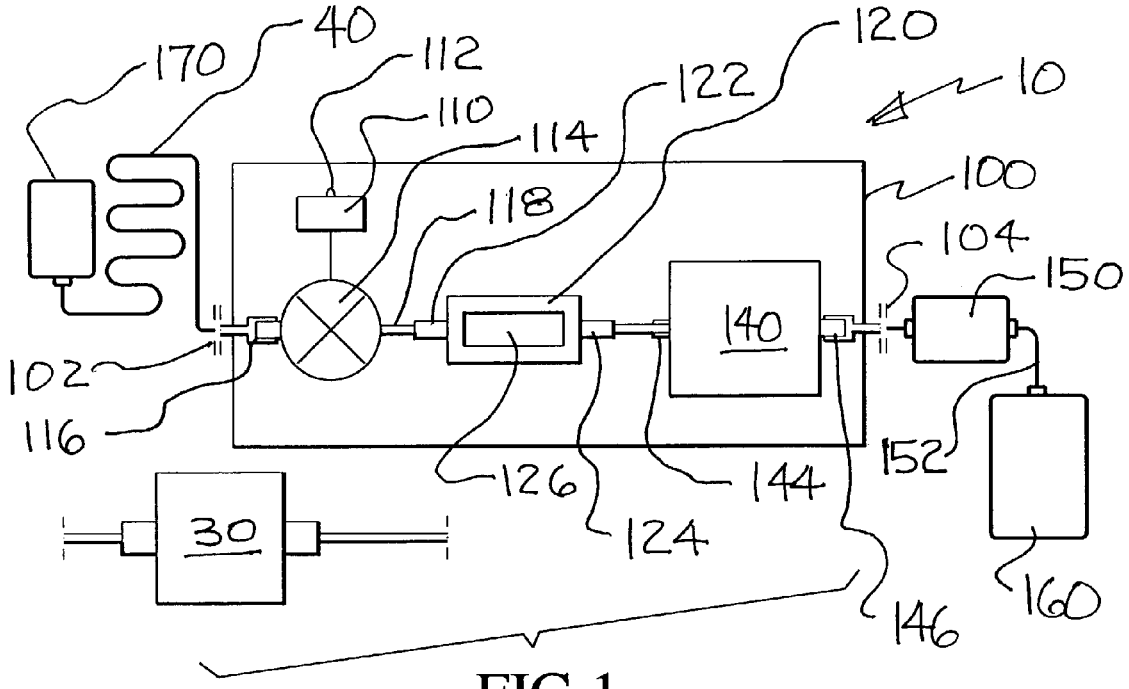
FIG. 1 is a schematic drawing which illustrates the device, system, and method for removing contaminants from a fluid, such as a liquid or gas.

FIG. 1 schematically illustrates a system 10 for decontaminating a fluid.

In use, system 10 may be a refrigeration system, for example. As shown, a compressor 30 has been removed from system 10. Compressor 30 may be the failed component of the refrigeration system that introduced contaminants into the system, for example. Removed compressor 30 could have typically been fluidly attached to a condenser 40.

In use, a fluid decontamination system 100 may be fluidly connected to the fluid containing device to be decontaminated at 102, such as the outlet of condenser 40. Decontamination system 100 may be likewise fluidly connected at a fluid outlet as shown at 104.

System 100 may include a differential pressure indicator 110, such as a vacuum indicator. Pressure indicator 110 may include an indicator light 112 having an ON condition and OFF condition, the ON condition being a condition when the pressure differential is sufficiently great to achieve a predetermined pressure differential, which ON condition may be indicated by indicator 112 lighting, for example, such as when indicator 112 is an LED light.

An optional valve 114 may be provided for regulating fluid flow, such as changing the flow into different passages, halting flow and the like.

A fluid inlet 116 and a fluid outlet 118 may be provided for one or both of pressure indicator 110 and valve 114.

An observation window 120, such as a sight glass, may be provided and fluidly connected with a fluid passage at an inlet 122, as well as at an outlet 124. A window or observation port 126 may be provided in observation window 120.

An optional filter 140 may be provided which has an inlet 144 and an outlet 146. Filter 140 may be fluidly connected in line with one or both of observation window 120 and pressure indicator 110. Filter 140 may be engineered and configured for filtering one or more types of contaminants such as particulates, oils, and water in systems in which no water is desired.

In use, it is contemplated that typically at least pressure indicator 110 and observation window 120 will be used.

Conveniently, filter 140 may be likewise provided for performing a filtering function, although a user may decontaminate a fluid, thanks to the provision of observation window 120 which allows the user to visually determine when the fluid passing observation port 126 is sufficiently free of contaminants that the decontamination process may be halted, without filter 140.

In use, a fluid pump 150 may be operatively connected to decontaminant system 100 for establishing a sufficient pressure differential in the fluid passage so that decontamination or flushing of the system, or both, may occur more readily. It will be appreciated that the decontamination process could be carried out simply by taking advantage of the force of gravity to cause fluid to be decontaminated to flow past the observation port 126 and into a receiver tank 160.

A fluid connection 152 may be provided between pump 150 and tank 160.

Still further, a flushing fluid such as a flushing refrigerant or virgin refrigerant tank or supply 170 may be fluidly connected to the contaminated device to be decontaminated. In the FIG. 1 example, the user is decontaminating condenser/evaporator 40.

In order to fluidly connect decontamination system 100 to condenser 40 and pump 150, for example, conventional fluid couplers or pieces of flexible tubing may be used.

Alternatively, one may use applicant's inventive quick release tool at one or both of connections 102 and 104, applicant's quick release tool being set forth in detail in applicant's concurrently filed application entitled "Quick Release Tool For Engaging Elongated Objects, Particularly Suited For Use With Tubing" application Ser. No. 10/351, 404, filed Jan. 27, 2003.

It will be appreciated that decontamination system 100 allows the user to remove or "dump" contaminated fluid, such as refrigerant, without the use of the conventional collector bag. Rather, the contaminated fluid can be dumped into receiver tank or recovery cylinder 160, thereby reducing time, increasing efficiency, and, in the case of a refrigerant, meeting Environmental Protection Agency (EPA) guidelines for refrigerant recovery. It has been found that significantly less flushing fluid such as virgin refrigerant is required to flush the system being decontaminated.

Although possible, the user need not use a prior art collection bag.

It will likewise be appreciated that one may use the observation window or sight glass 120 alone and still achieve the desired results; i.e, by observing the presence or lack of contaminants in fluid passing the sight glass 126, the user may determine whether the fluid is sufficiently contaminant free to halt the flushing process.

One or more valves 114 are likewise optional.

As set forth above, a pressure indicator 110 and observation window 120 suffice to yield a flushing system 100 that achieves rapid flushing.

In use, such as with a refrigeration system, compressor 30 is removed, the outlet of condenser 40 is attached to valve 114 while valve is in its OFF position blocking flow. The outlet on the valve is attached to the recovery cylinder, air is released to the atmosphere, as required to purge atmospheric air. The pump or compressor 150 is then turned on, valve 114 is open so that refrigerant goes into recovery tank 160 from pump 150 via filter 140 and sight glass 120. Flushing or purging is continued until one sees liquid refrigerant in window 126, then flushing refrigerant cylinder 170 is closed, and the user pumps out the high pressure refrigerant using gravity where possible to assist, if desired.

Pumping, pressurizing, cycling of fluid is continued until no residue shows in window 126; i.e., until fluid being decontaminated is sufficiently decontaminated based on the user's observations.

Figure 2:
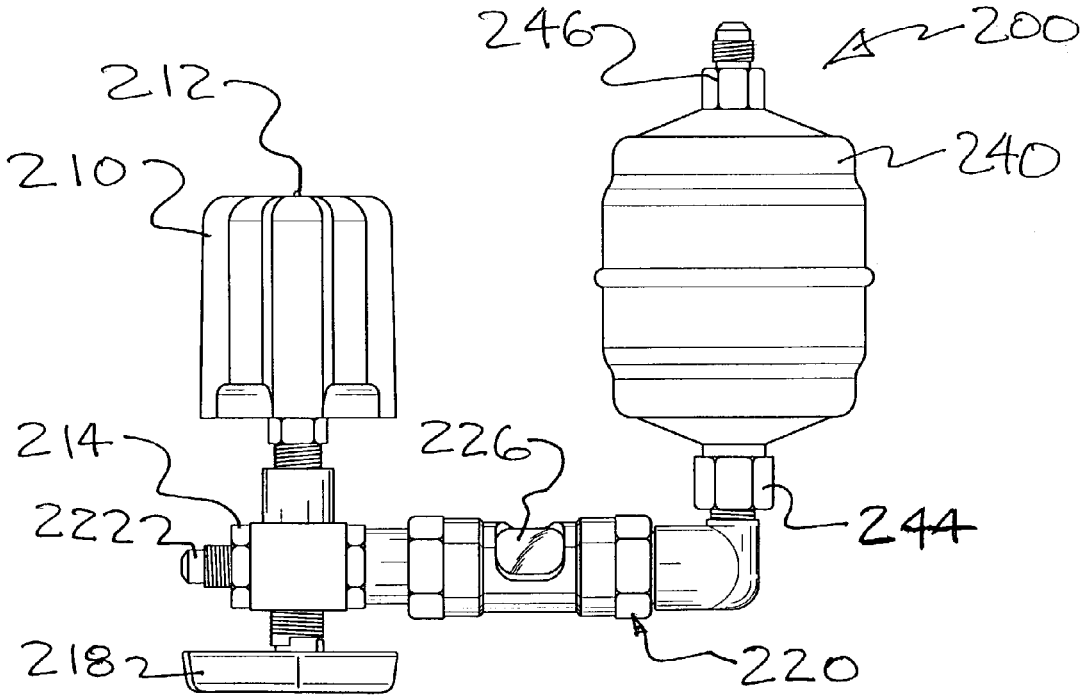
FIG. 2 is a side elevational view of an embodiment of a device for removing contaminants from a fluid.

FIG. 2 illustrates an example of an apparatus or device 200 for use in decontaminating fluid, such as a refrigerant.

Device 200 may be used in the system and method of FIG. 1, such as by substituting device 200 for the schematically illustrated system of FIG. 1.

Device 200 may include a differential pressure indicator 210, such as a vacuum indicator. Pressure indicator 210 may include an indicator light 212 which lights when a predetermined differential pressure has been achieved. A valve 214 having a handle 218 for directing and regulating fluid flow within the valve may be provided. Valve 214 may likewise have an inlet 222.

Device 200 may include an observation device 220 which includes an observation window 226, such as a sight glass.

A filter 240 may be provided for filtering out one or more contaminants, such as filter 140 of the embodiment of FIG. 1. Filter 240 may include an inlet 244 and an outlet 246.

In a simpler form, along the lines described in connection with system 100 of FIG. 1, only an observation device 220 configured for allowing a user to observe fluid flow therethrough need be provided in order to carry out the decontamination of the fluid according to the invention.

In another form, differential pressure indicator 210 together with observation window 220 may be used to carry out the decontamination method according to the invention.

If desired, filter 240 may be fluidly connected for filtering out one or more contaminants from the system being flushed.

In use, the user may connect inlet 222 to a fluid system being decontaminated, and the user may likewise connect outlet 246 to a recovery cylinder 160, along the lines described above in connection with the system and method of FIG. 1.

While this invention has been described as having a preferred design, it is understood that it is capable of further modifications, uses and/or adaptations of the invention following in general the principle of the invention and including such departures from the present disclosure as come within the known or customary practice in the art to which the invention pertains and as may be applied to the central features hereinbefore set forth, and fall within the scope of the invention and of the limits of the appended claims.

The invention claimed is:

1. A method for decontaminating a fluid, comprising:

a) providing a system containing a contaminated fluid and a fluid passage;

b) providing an inlet and an outlet in the fluid passage;

c) fluidly connecting a differential pressure gauge and an observation window of the type which is configured to allow a user to observe a fluid flowing in the fluid passage to the outlet in the system;

d) causing a refrigerant fluid to be decontaminated to pass through the fluid passage and past the observation window so that the user may determine whether a contaminant is present in the fluid to be decontaminated;

e) causing the fluid to flow past the observation window until a user has determined that the fluid has been sufficiently decontaminated;

f) a flushing refrigerant is introduced into the inlet;

g) introducing a flushing refrigerant until an observer determines by observation of the observation window that a refrigerant is visible in the observation window;

h) the introducing of flushing refrigerant is halted, and a negative pressure is induced at the outlet of the passage until a predetermined pressured differential has been indicated by the pressure differential indicator;

i) flushing refrigerant is again introduced into the inlet, and then the introduction of flushing refrigerant is halted after refrigerant has again been observed in the observation window; and j) the steps of establishing a negative pressure, introducing flushing refrigerant, and observing refrigerant in the observation window are repeated until the observer determines that the refrigerant observed in the observation window is sufficiently free of contaminant and that the refrigerant has been sufficiently decontaminated.

2. A method as in claim 1, wherein:

a) the introducing of a flushing refrigerant into the inlet is introduced from a refrigerant cylinder.

3. A method as in claim 1, further comprising the step of:

a) operatively connecting a pump to the fluid passage.

4. A method as in claim 1, further comprising the step of:

a) fluidly connecting a receiver tank to the outlet of the fluid passage, the receiver tank being configured for receiving fluid which has been observed in the observation window.

5. A method as in claim 3, wherein:

a) the pump is fluidly connected to the outlet.

6. A method as in claim 1, wherein:

a) a filter device is fluidly connected to the fluid passage, the filter device being configured for removing at least one contaminant from a fluid in the fluid passage.

7. A method as in claim 6, wherein:

a) a valve is provided, the valve being fluidly connected to the fluid passage for regulating flow of a fluid in the passage.

8. A method as in claim 1, wherein:

a) the differential pressure indicator includes a vacuum indicator.

9. A method as in claim 1, wherein:

a) a valve is provided, the valve being fluidly connected to the fluid passage for regulating flow of a fluid in the passage.

* * * * *